US006088921A

United States Patent [19]

Valento

[11] Patent Number: 6,088,921

[45] Date of Patent: Jul. 18, 2000

[54] CAN OPENER WITH A LID MAGNET

[76] Inventor: Joseph P. Valento, 9159 Dinsdale St., Downey, Calif. 90240

[21] Appl. No.: 09/302,532

[22] Filed: Apr. 30, 1999

[51] Int. Cl.[7] ..... B67B 7/46

[52] U.S. Cl. ..... 30/410; 30/422; 30/427

[58] Field of Search ..... 30/410, 424, 425, 30/422, 427

[56] References Cited

U.S. PATENT DOCUMENTS 2,265,491 12/1941 Powers ..... 30/410

*Primary Examiner*—Douglas D. Watts
*Attorney, Agent, or Firm*—Vic Y. Lin

[57] ABSTRACT

The present invention is a can opener with a manual turning knob and a magnet. The can opener has a first cutting side, second turning side, an upper handle, and a lower handle. The manual turning knob comprises a wheel with indentations. The top of the wheel may be flat, allowing the user to turn the wheel with his or her palm. The manual turning knob is disposed adjacently to the second turning side on a pivot post which intersects the lower handle. Attached on the opposite end of the pivot post is a driving toothed wheel which rotates upon rotation of the manual turning knob. A cutting edge or disk is disposed adjacently to the first cutting side on an upper rivet, the upper rivet extending out from the first cutting side of the upper handle. A magnet is disposed on or adjacent to the cutting disk such that a completely severed lid of a can will rotate toward the magnet. The magnet and cutting edge are angled downward toward the lid of the can. The invention is also a method of opening a can that prevents the lid from dropping or immersing into the food contents of the can.

1 Claim, 3 Drawing Sheets

CAN OPENER WITH A LID MAGNET

RELATED DISCLOSURE

Applicant hereby references Disclosure Document No. 421205 received by the U.S. Patent and Trademark Office on May 29, 1997.

BACKGROUND OF THE INVENTION

1. Field of the Invention

The invention relates to can openers with manual turning knobs.

2. Description of Prior Art

All types of food are stored in cans sealed with metallic lids. The outside surface of the lid is exposed to all types of contaminants, such as dust, or dirt from packaging, storage and handling. In opening cans, it is important for obvious sanitation reasons that the outer surface of the lid does not contact any portion of the food in the can.

It is equally important for safety reasons that can openers allow the user to easily sever a lid from a can and to remove the severed lid.

In the prior art, can openers with manual turning knobs focus primarily on severing the lids of cans. Even so, many of the manual turning knobs developed are spherical, round, bar-shaped or rectangular in shape. Such a design is difficult for users who have arthritis, since turning a rectangular knob requires greater flex or rotation of the wrist, thus causing stress and consequent pain to the user with an arthritic wrist.

Severing the lid from the can, however, is only half of the process of opening a can. Safely removing a severed lid is equally important. To avoid having the external or top surface of the lid contact the food contents, a user will often avoid completely severing the lid. Leaving a small portion of the boundary of the lid attached to the can keeps the lid from being immersed in the food contents. However, the user must then use his or her hands or a knife to twist and turn the lid such that it will completely detach from the can. This dangerous use of the hands often leads to cuts from the sharp edge of the lid as the user attempts to somehow detach the lid.

Alternatively, a user may choose to completely sever the lid using the prior art can openers. However, once the lid is completely severed, the lid will drop and immerse into the food contents. This poses serious sanitation problems as the contaminants from the outer surface of the lid become absorbed by the food contents.

Therefore, what is needed is a can opener that makes it easier for the user to turn, prevents the upper surface of the lid from touching the food contents, and provides a safe way for removing the lid. What is also needed is a method of opening a can that will accomplish the above objectives.

BRIEF SUMMARY OF THE INVENTION

The invention is a can opener having a turning knob and a magnet. In the simplest form, the invention comprises a cutting edge on a first cutting side of the can opener, a magnet disposed on the first cutting side of the can opener, and a turning knob disposed on a second turning side of the can opener.

The preferred embodiment comprises a turning knob in the shape of a wheel having indentations adapted to allow convenient engagement with the finger tips. The wheel shape along with the indentations make turning easier by limiting the amount of flex or rotation needed in the wrist necessary to turn the can opener. The top of the wheel may be flat, allowing the user to turn the wheel with his or her palm. As an example, the wheel may have a 4-inch diameter. The top of the wheel may also have indentations.

The preferred embodiment comprises an upper and lower handle. An upper rivet extends out from the first cutting side of the upper handle. Attached to the upper rivet is a driven toothed wheel. Attached to the upper rivet and distal to the driven toothed wheel is a cutting disk. A magnet having a magnetic pole is attached to the cutting disk, though it may be disposed anywhere adjacent to the cutting disk or cutting edge, such that the lid of a can will rotate and stick to the lid, as a result of magnetic forces, upon being completely severed from the can. The driven toothed wheel, cutting disk, and magnetic pole are angled downward toward the lid of the can.

A pivot post intersects the lower handle. A turning knob is attached to the pivot post and adjacent to the second turning side. A driving toothed wheel is attached to the pivot post and adjacent to the first cutting side. A guiding wheel is attached to the pivot post and is distal to the driving toothed wheel. Since the turning knob, driving toothed wheel, and the guiding wheel are all fixed on the pivot post, rotating the turning knob also rotates the driving toothed wheel and the guiding wheel.

When operating the can opener, the can opener is secured to the top of the can. The guiding wheel rests against the side of the can. The cutting disk contacts the lid at its boundary. Upon rotating the turning knob, the cutting edge severs the lid at its boundary, causing the lid to rotate toward the magnet as it being severed. Once the lid is completely severed, the lid immediately rotates toward and attaches to the magnet as a result of magnetic force. The lid may be lifted upward depending upon the placement of the magnet.

Therefore, in summary it can be appreciated that the invention makes it easier for a user to turn the turning knob. It can also be appreciated that the invention increases safety as a user no longer needs to use his or her hands to detach an otherwise partially severed lid. The invention preserves sanitation as it keeps the lid from dropping into the food contents.

The invention can also be characterized as a method for opening a can comprising providing a can opener having a manual turning knob, a cutting edge, and a magnet, securing the can opener to the can such that the cutting edge contacts the lid of the can, rotating the manual turning knob to sever the lid from the can, and attracting the lid to the magnet once the lid is severed from the can.

The invention now having been briefly summarized, it may be better visualized by turning to the following drawings wherein like elements are referenced by like numerals.

The invention and its various embodiments can now be better understood by turning to the following detailed description wherein an illustrated preferred embodiments is described. It is to be expressly understood that the illustrated embodiment is set forth as an example and not by way of a limitation to the invention as defined in the following claims.

DETAILED DESCRIPTION OF THE PREFERRED EMBODIMENTS

The present invention is a can opener with a manual turning knob and a magnet. The can opener has a first cutting side, second turning side, an upper handle, and a lower handle. The manual turning knob comprises a wheel with indentations arranged and configured to allow convenient engagement or manipulation with the fingers on one hand. The top of the wheel may be flat, allowing the user to turn the wheel with his or her palm. The manual turning knob is disposed adjacently to the second turning side on a pivot post which intersects the lower handle. Attached on the opposite end of the pivot post is a driving toothed wheel which rotates upon rotation of the manual turning knob. A cutting edge or disk is disposed adjacently to the first cutting side on an upper rivet, the upper rivet extending out from the first cutting side of the upper handle. A magnet is disposed on or adjacent to the cutting disk such that a completely severed lid of a can will rotate toward the magnet. The magnet has a magnetic pole. The magnet pole and cutting edge are angled downward toward the lid of the can. The invention is also a method of opening a can that prevents the lid from dropping or immersing into the food contents of the can.

Figure 1:
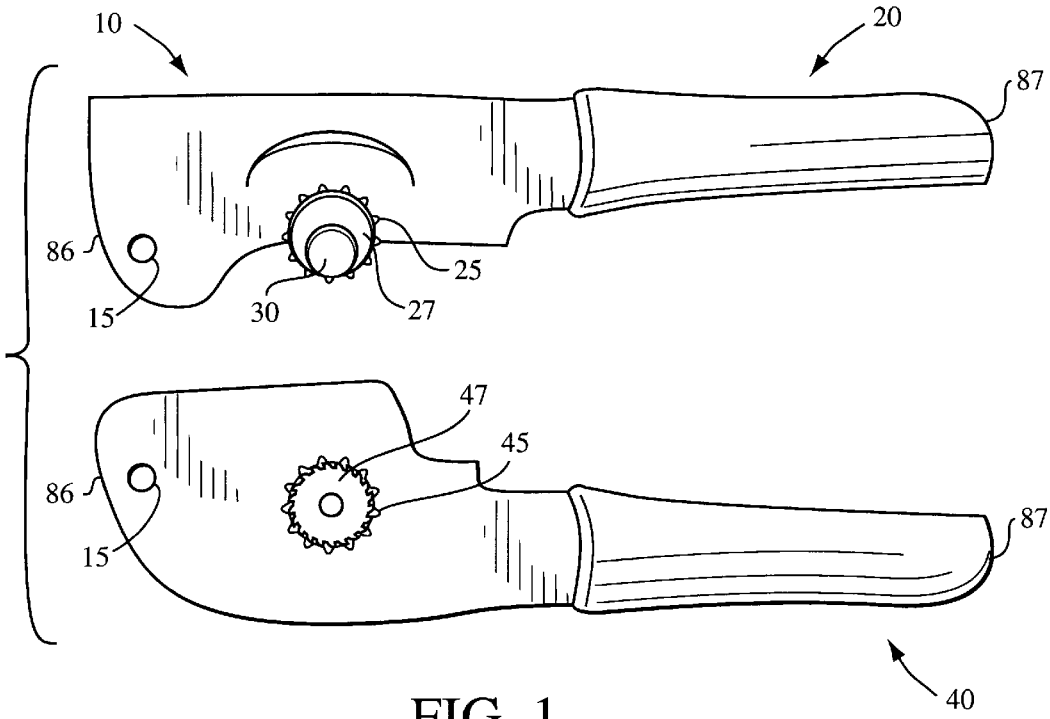
FIG. 1 is an exploded elevational view of the first cutting side of the can opener.
Figure 3:
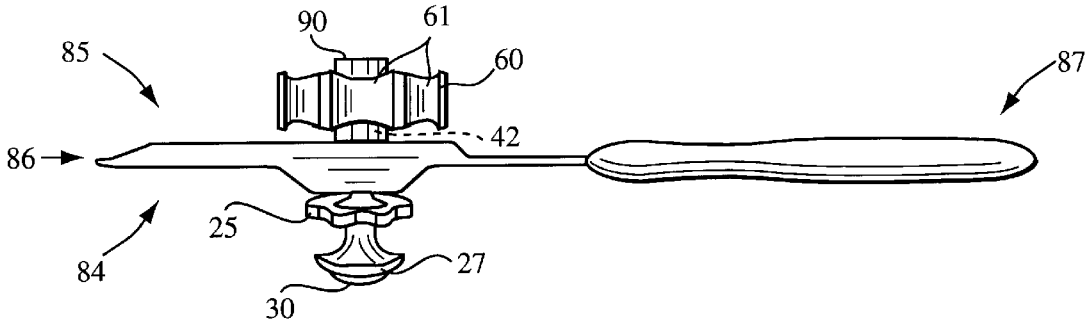
FIG. 3 is a top elevational of the can opener.

FIG. 1 is an exploded elevational view of the first cutting side of the can opener. The preferred embodiment of the invention, generally denoted by reference numeral 10, comprises upper handle 20 and lower handle 40. Upper handle 20 and lower handle 40 are connected by hinge 15. Referring to FIG. 3, can opener 10 has a first cutting side 84 and a second turning side 85 as well as front end 86 and back end 87.

Figure 2:
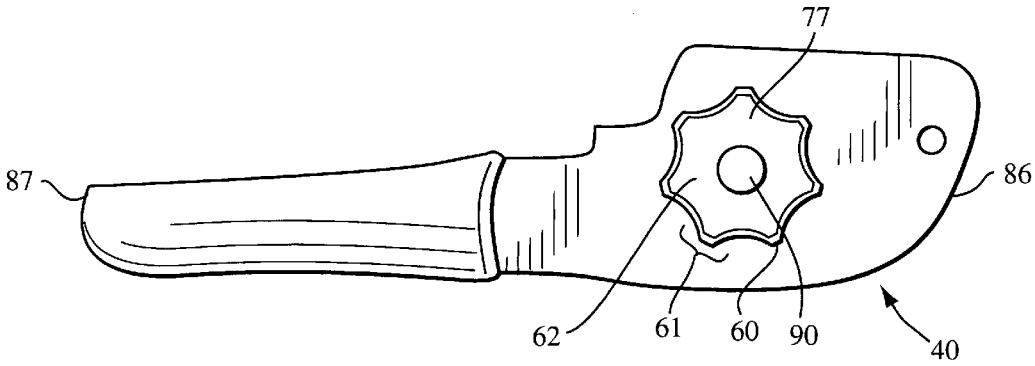
FIG. 2 is an elevational view of the second turning side of the lower handle of the can opener.

In FIG. 3, a pivot post 42 intersects lower handle 40. Adjacent to second turning side 85 is a manual turning knob 60 attached to pivot post 42. As shown in FIG. 2, manual turning knob 60 comprises a wheel 62 with indentations 61 such as scalloped cuts into the periphery of a circular wheel which are adapted for easy engagement with the finger tips of one hand. Wheel 62 can thus be turned by engaging wheel 62 with two or more finger tips and pushing or rotating wheel 62 entirely or substantial by finger manipulation only with little or no rotation of the wrist joint. Top 77 of wheel 62 may be flat, allowing the user to turn wheel 62 with his or her palm. As an example, wheel 62 may have a 4-inch diameter. Wheel 62 may also have indentations 79 on top 77.

Driving toothed wheel 45 is coupled to pivot post 42 and adjacent to first cutting side 84. Pivot post 42 is rotatable so that rotation of wheel 62 is translated into rotation of driving toothed wheel 45. Guiding wheel 47 is also coupled to pivot post 42 to rotate with it and is distal to the driving toothed wheel 45 on pivot post 42. Pivot post 42 is disposed through a bushing 43, 44 fixed to lower handle 40, disposed therethrough. Pivot post 42 is rotatable in and retained by bushing 43, 44. The portion of the bushing disposed on turning side 85 is designated by reference numeral 44 and the portion of the bushing disposed on cutting side 84 is designated by reference numeral 43. The manner of construction of bushing 43, 44 and pivot post 42 is conventional and will not be further described. Any type of drive mechanism for coupling the rotation of wheel 62 to the rotation of driving toothed wheel 45 now known or later devised may be employed.

Figure 4:
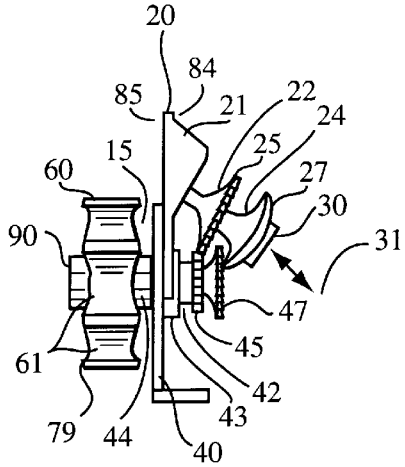
FIG. 4 is a front end elevational view of the can opener in a closed position.

In FIG. 4, upper rivet 22 is attached to upper handle 20 and extends out from first cutting side 84. Attached to upper rivet 22 and adjacent to first cutting side 84 is driven toothed wheel 25. Driven toothed wheel 25 is disposed on upper rivet 22 such that when can opener 10 is closed, driven toothed wheel 25 is in gear with driving toothed wheel 45. Attached on upper rivet 22 and distal to driven toothed wheel 25 is a cutting disk 27. Cutting disk 27 is adjacent to first cutting side 84. Though the preferred embodiment of the invention shows a cutting disk 27, it should be expressly understood that any cutting edge may be provided by one skilled in the art without departing from the spirit and scope of the invention.

Permanent magnet 30 is disposed adjacently to first cutting side 84. In the preferred embodiment, magnet 30 is disposed on cutting disk 27. Magnet 30 may be disposed adjacently to cutting disk 27. Magnet 30 has its magnetic poles 31 oriented on its flat circular opposing faces, namely the north or south magnetic pole of magnet 30 is oriented to point perpendicularly out of or into the flat faces of the disk-shaped magnet. It is immaterial whether the north or south pole of magnet 30 is oriented outwardly. In the illustrated embodiment, magnet 30 has a right circular cylindrical shape with a diameter greater than it height so as to assume the shape of a flat circular disk. However, any other geometric shape may be employed, although having an orientable flat face on which the magnetic poles are defined is advantageous to the operation of the invention as will become clear in the following description.

As shown in FIG. 4, when can opener 10 is in a closed or operating position, driven toothed wheel 25 is engaged with driving toothed wheel 45. In the preferred embodiment, driven toothed wheel 25, cutting disk 27, and the magnetic pole 31 are angled downward toward lid 71 of can 70. This may be accomplished with curved boss 21 defined on cutting side 84.

Figure 5:
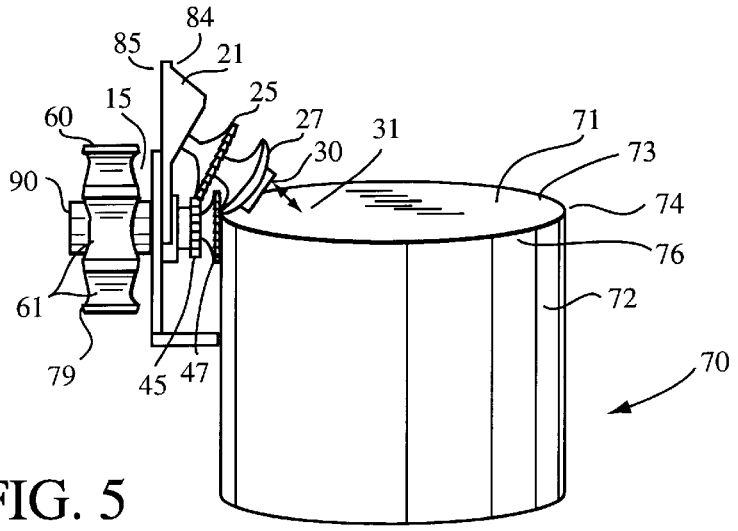
FIG. 5 is a front end elevational view of the can opener secured to a can.
Figure 6:
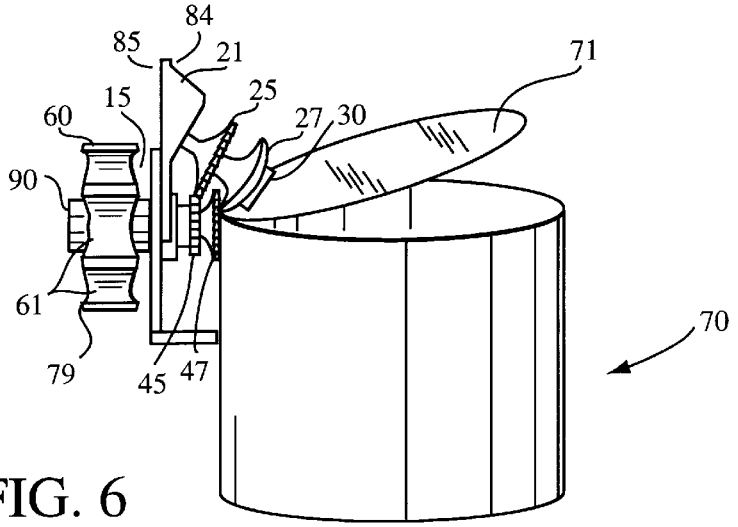
FIG. 6 is a front end elevational view of the can opener severing the lid of a can.
Figure 7:
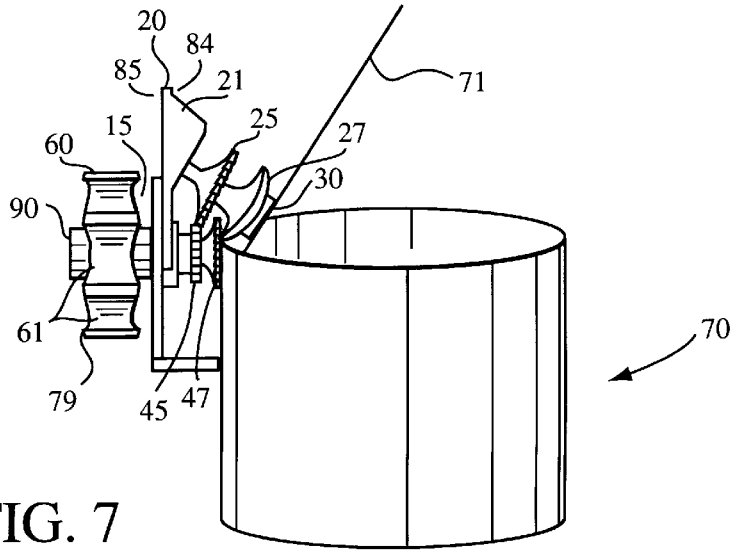
FIG. 7 is a front end elevational view of the can opener after the lid has been completely severed from the can.

The structure of can opener 10 now having been described, turn now to its operation by referring to FIGS. 5–7. Since manual turning knob 60, driving toothed wheel 45, and guiding wheel 47 are all coupled or fixed to pivot post 42, rotating manual turning knob 60 also rotates toothed wheel 45 and guiding wheel 47. In a closed position, rotation of toothed driving wheel 45 will also rotate toothed driven wheel 25 since both wheels are in gear. Rotation of driven toothed wheel 25 rotates cutting disk 27 thereby aiding in the cutting operation and also rotation a new portion of cutting disk 27 to the can lid at each point. Guiding wheel 47 is provided with a plurality of circumferential, radially extending teeth to engage the can lip 74, typically on the lower edge of lip 74 of can 70 where the cylindrical side of can 70 is connected or crimped to can lid 71. This is usually the primary means by which can 70 itself is also rotated by the rotation of wheel 62. FIG. 5 shows can opener 10 being secured on top of can 70. Guiding wheel 47 rests against side wall 72 and underneath lip 74 of can 70 in contact with lip 74. Cutting disk 27 is positioned at lid boundary 73 of lid 71. Squeezing upper and lower handles 20 and 40 together drives cutting wheel 27 into lid 71, often in conjunction with and assisted by the rotation of can 70 and cutting wheel 27.

FIG. 6 shows can opener 10 in the process of cutting can 70. As manual turning knob 60 is turned, lid 71 will be severed from can 70 and at a certain point of the cutting operation will or may begin to rotate toward magnet 30. In FIG. 7, once lid 71 is completely severed from can 70, lid 71 quickly rotates toward magnet 30 and attaches to magnet 30 as a result of magnetic torque applied to it by magnet 30. Magnet 30 may or may not touch lid 71 and need only be near enough to it to apply sufficient magnetic torque to rotate and/or lift lid 71 out of the top of can 70. The magnetic strength of magnet 30 can be easily varied over a wide range to provide the needed force in a variety of physical embodiments. Typically, lid 71, when completely severed, snaps up into contact with the flat face of magnet 30. Because magnet 30 makes no physical contact with lid 71 or at most lightly touches lid 71, lid 71 is never strongly pressed down into can 70 so that the upper surface of lid 71 comes into contact with the contents of can 70. The contents of can 70 normally could only come into contact with the upper surface of lid 71 only if there were a native, positive pressure in can 70 which forced the contents out through an initial puncture in lid 71. This typically does not occur to any great extent unless there is unintended spoilage in can 70 in which case there may be more obvious signs of distension, which would cause can 70 to be discarded.

On the other hand, in many electric can opener mechanisms a pickup magnet is force downward by a spring into contact with lid 71, so that when lid 71 is completely severed there is a tendency to force lid 71 into can 70 leading to extrusion of the contents onto the top surface of lid 71. When can 70 is removed or drawn away from lid 71, natural suction cause by the removal can then cause some of this content material to be drawn back down into can 71. This is avoided by the present invention which does not press lid 71 into can 70 and which immediately rotates lid 71 up and away from the contents the instant that lid 71 is first completely severed from can 70.

The shape of the wheel 62 with indentations 61 in manual turning knob 60 allows a user to more easily turn knob 60 without straining or substantially rotating the wrist joint. Magnet 30 allows a user to completely sever lid 71 without allowing lid 71 to touch the food contents inside can 70. Thus, a user need not use his or her hands to twist and turn away an otherwise partially attached lid. Also, can opener 10 prevents lid 71 from dropping into can 70 because as soon as lid 71 is completely severed from can 70, magnetic pole 31 will immediately pull lid 71 toward magnet 30, causing lid 71 to rotate toward magnet 30. Depending upon how high up magnet 30 is disposed from top 76 of can 70, lid 71 may also be lifted upward toward magnet 30.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims.

For example, can opener 10 may also be provided with a permanent magnet 90 coupled to wheel 62 in lieu of magnet 30 or in combination with magnet 30 to allow an additional means of lifting lid 71 from can 70. In this case can opener 10 would of course need to be manually manipulated to bring magnet 90 into magnetic engagement with lid 71 after being severed from can 70. This would occur only if magnet 30 were missing or there was some inadvertent disengagement of magnet 30 from lid 71 and reengagement of magnet 30 were for some reason inconvenient.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention. Where an element is referred to in the singular form, the claims are to be understood as including the plural form. Where an element is referred to in the plural form, the claims are to be understood as including the singular form.

Furthermore, the claims are to be understood as comprising embodiments beyond what is described in this specification. This applies particularly to the method claims wherein countless varieties of structural elements may read upon those claims.

I claim:

1. A can opener for opening a lid of a can, the can opener having a front and back end, a first cutting side, a second turning side, an upper and lower handle, a pivot post intersecting the lower handle, a turning knob attached to the pivot post and adjacent to the second turning side, a driving toothed wheel coupled to the pivot post and adjacent to the first cutting side, a guiding wheel coupled to the pivot post and distal to the driving toothed wheel, an upper rivet disposed on the upper handle, a driven toothed wheel rotatably coupled to the upper rivet and adjacent to the first cutting side, the driven toothed wheel engaged with the driving toothed wheel when the can opener is in a closed position, a cutting disk attached to the upper rivet, the cutting disk being adjacent to the first cutting side and distal to the driven toothed wheel, the can opener comprising:

a manual turning knob attached to the pivot post and adjacent to the second turning side, the manual turning knob comprising a wheel with finger indentations; and a magnet disposed on the cutting disk, the magnet having a pole face, wherein the pole face of the magnet, the cutting disk, and the driven toothed wheel are angled downward toward the lid of the can such that the magnet causes the lid of the can to rotate and attach to the magnet when the lid has been severed from the can.

* * * * *